United States Patent [19]

Jones

[11] 4,040,592

[45] Aug. 9, 1977

[54] DESK TOP WORK SUPPORT DEVICE

[76] Inventor: Robert E. Jones, 4818 Marathon Drive, Madison, Wis. 53705

[21] Appl. No.: 721,703

[22] Filed: Sept. 9, 1976

[51] Int. Cl.[2] ..... A47G 1/24

[52] U.S. Cl. ..... 248/460; 248/454

[58] Field of Search ..... 248/454, 455, 457, 460, 248/461, 462, 463, 281; 312/196, 231, 233; 108/1, 6, 7, 9; 45/131

[56] References Cited

U.S. PATENT DOCUMENTS

| | | | |
|---|---|---|---|
| 928,614 | 7/1909 | Mohr | 248/463 |
| 1,301,406 | 4/1919 | Dierks | 248/454 |
| 1,420,439 | 6/1922 | Moore | 248/454 |
| 2,252,215 | 8/1941 | Stearns | 108/7 |
| 2,640,748 | 6/1953 | Holmberg | 108/6 |
| 3,875,872 | 4/1975 | Kayner | 108/1 |
| 3,980,266 | 9/1976 | Jones | 248/454 |

*Primary Examiner*—Robert A. Hafer

*Attorney, Agent, or Firm*—Theodore J. Long; John M. Winter; Harry C. Engstrom

[57] ABSTRACT

A desk top work support device having a primary work support member pivotally mounted in an opening in a desk top. A pair of link arms mounted on the primary work support member rotatably support a secondary work support member, and are pivotable to position the secondary work support member in a forward position over the primary work surface and a rearward position to the rear of the primary work surface. A rotating mechanism causes the secondary work support member to rotate with respect to the link arm when the link arm is pivoted. A drive train is provided for rotating the rotating mechanism and the secondary work support bar independently of movement of the link arms, and a second drive train is provided for pivoting the link arms.

17 Claims, 8 Drawing Figures

DESK TOP WORK SUPPORT DEVICE

CROSS REFERENCE TO RELATED APPLICATION

The present application is related to U.S. patent application Ser. No. 536,610, filed Dec. 26, 1974, and entitled Desk Top Work Support Device, now U.S. Pat. No. 3,980,266.

BACKGROUND OF THE INVENTION

1. Field of the Invention

This invention relates generally to improved environmental design of work surfaces utilized for desk work and more particularly to a desk top work support device for sustained combination reading and writing tasks.

In my above identified co-pending patent application I have described in detail the interactions which occur during sustained close visually-centered tasks such as reading and writing separately and in combination between the work support mechanisms, the body support mechanisms, the human organism, and the light source. Studies have shown that the body tends to grow or adapt along lines of stress. The body and especially the torso will reflexively position itself so that an object to be viewed is essentially perpendicular to the observer's line of sight. For a close visual or eye motor task as might be ordinarily performed when using a flat desk and a chair, a person must hunch over the table to obtain adequate visual contact. The short-term effects of this hunching are his sacrifice of comfort and premature fatigue and/or restlessness. The longer term effects are the result of postural accommodations which typically exceed the normal limits of human adaptation and lead to a series of problems, important among which are the inability to characteristically stand erect, concomitant vision problems, and finally a progression of osteo arthritis of the neck and/or lower back.

These conditions can be minimized or perhaps even prevented by adequate work environment design. In my co-pendng patent application, I have disclosed a desk top work support device having a primary work support surface for predominantly writing tasks which may be placed at approximately 20° with the horizontal, and a secondary work support member for predominantly reading tasks which may be placed in relative close proximity, typically about 16 inches, to the user at an inclination of approximately 70° with the horizontal, and may alternatively be placed in a second position more distant from the user wherein the secondary work support member will support reference materials for secondary or occasional reading but will not interfere with unrestricted use of the primary work surface. In addition, to permit use of a single light source without reflection or "glare" problems, and to obtain additional flexibility and adaptability, my co-pending application discloses a mechanism for changing the angle of the secondary work support member to the horizontal when the member is moved between its close reading and secondary reference positions. The present invention described herein relates to an alternate construction for an environmentally designed desk top work support device which employs novel and additional mechanism not previously specifically disclosed.

2. Description of the Prior Art

The use of an inclined work surface is well known, as in the drafting table art. The use of raised work holders is also well known as in work stands for holding copy in connection with typing tasks, and in stands for holding music for musicians. Although limited attempts have been made to combine a book support or similar work holder with a desk, none except my previous device disclosed in my above identified co-pending application have satisfactorily provided a combination of inclined primary work surface and secondary work support member which is both movable and provides a desirable change of inclination betwen forward reading positions and rearward secondary reference positions. In addition, none have provided a device which may be incorporated in an otherwise conventional desk wherein the desk has the appearance and function of a normal desk when the device is in its storage position, but which may be easily set up and adjusted to an adequate work environment design.

It is believed that my invention disclosed herein satisfies the conditions necessary for an adequate work environment relating to work surfaces in a manner that is heretofore unknown in the industry.

SUMMARY OF THE INVENTION

My new and improved desk top work support device has been designed specifically to permit incorporation of the device in an otherwise conventional desk in such a manner that the device may be stored within the desk to provide a substantially flat, continuous work surface substantially similar to that of a conventional desk. It may also be adapted for portable use without desk mounting. When my improved desk top work support device is converted to a working position, it provides an inclined primary work support member upon which is pivotally mounted a secondary work support member which may be pivoted between a forward position directly over the primary work support surface and a rearward position substantially rearwardly displaced from the forward position. At the same time, a rotating mechanism may be provided to change the angle of the work support member with respect to the primary work surface. All movable components are easily adjusted, preferably by use of operating mechanism connected in driving relation to the pivoting and rotating members of my device.

It is an object of the present invention to provide a desk top work support device with improved environmental design having a rotatable secondary work support member and improved controls for moving the secondary work support member between operating positions and a storage position.

It is a further object of the present invention to provide a desk top work support device which may be incorporated in an otherwise conventional office desk and having a storage position in which my desk top work support device cooperates with the desk top to provide a substantially flat, conventional desk surface.

Other objects, features and advantages of my invention will be apparent from the following detailed description wherein a preferred embodiment of the invention has been selected for exemplification.

DESCRIPTION OF THE PREFERRED EMBODIMENT

Figure 1:
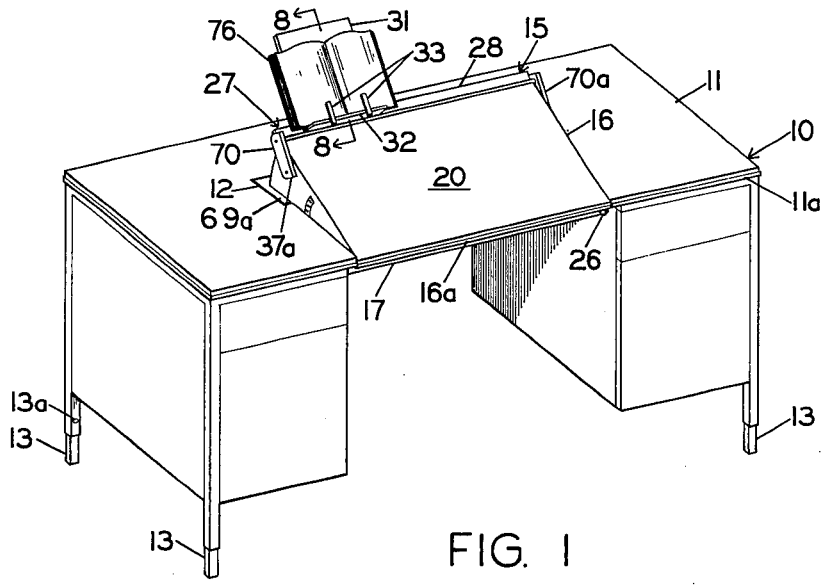
FIG. 1 is a perspective view showing my improved desk top work support device mounted in a desk with the primary work support member in an inclined working position.

Referring more particularly to the drawings, wherein like numerals refer to like parts throughout the several views, FIG. 1 illustrates a preferred embodiment of my improved desk top work support device 15, wherein it is mounted in a desk 10 of otherwise conventional design. The illustrated desk 10 is typical of commercial office and study desk and need not be described in detail, except as to modifications to accommodate my device, as the conventional desk details are not important to an understanding of my invention. The desk 10 has a top 11 with a flat upper surface. In order to accommodate the mounting of my work support device 15, the desk top 11 has a cutout opening 12, the upper outline of which is shown best in FIG. 2. The particular shape of the cutout opening 12 will be described in more detail with specific reference to the elements of my desk top work support device which are shown fitting flush with the flat upper surface of the desk top 11 to provide a substantially continuous flat work surface similar to a conventional desk when the particular structure and advantages of my work support device are not desired to be utilized. The illustrated desk 10 also has adjustable telescoping legs 13 to permit adjustment of the height of the desk for an individual user to provide a work environment which meets the particular needs of the user. In the preferred embodiment, the legs 13 are vertically adjustable by means of a set screw 13*a* on each leg to provide an adjustment desk top height of from 26 to 32 inches.

Figure 2:
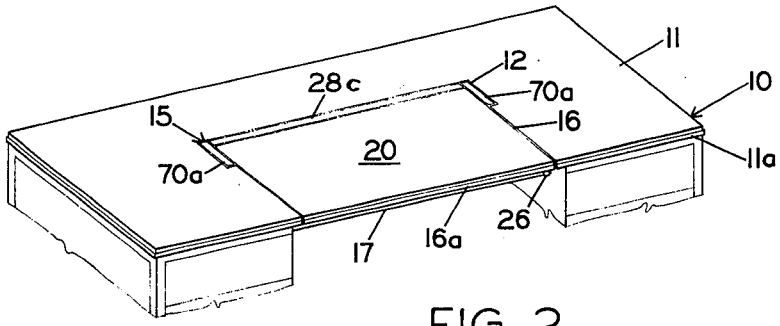
FIG. 2 is a partial perspective view showing my improved desk top work support device mounted in a desk with the primary work support member, the link arms and the secondary work support member in storage position substantially flush with the surface of the desk top.
Figure 3:
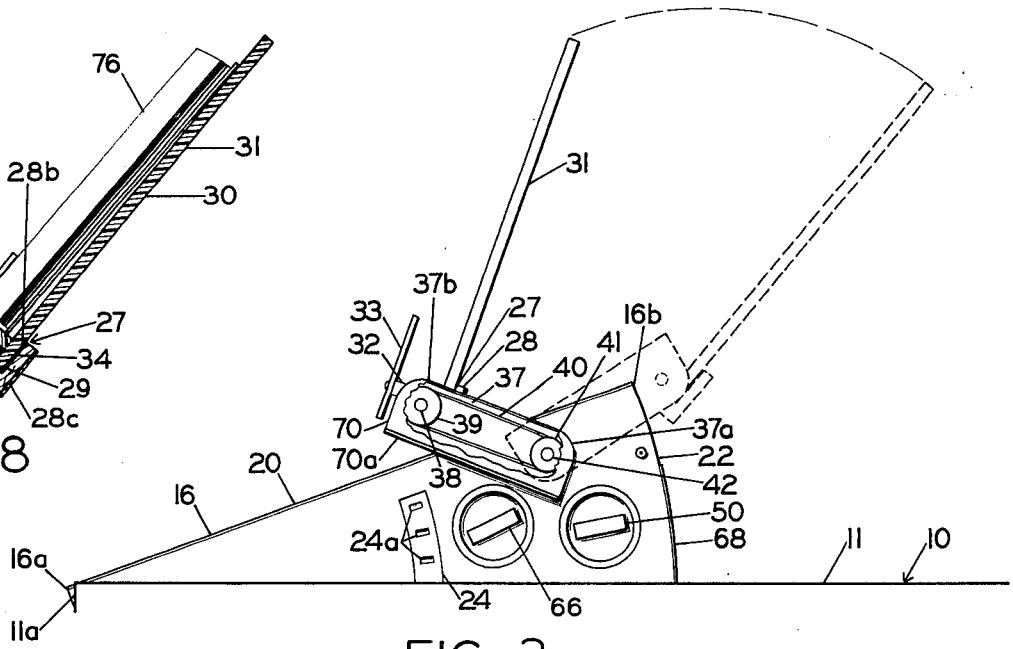
FIG. 3 is a side view of my desk mounted work support device wherein the primary work support member is in an inclined position, the secondary work support member is supported by forwardly extending link arms in a close reading position, and broken lines illustrate the link arms extending rearwardly to support the secondary work support member in a secondary reference reading position.
Figure 7:
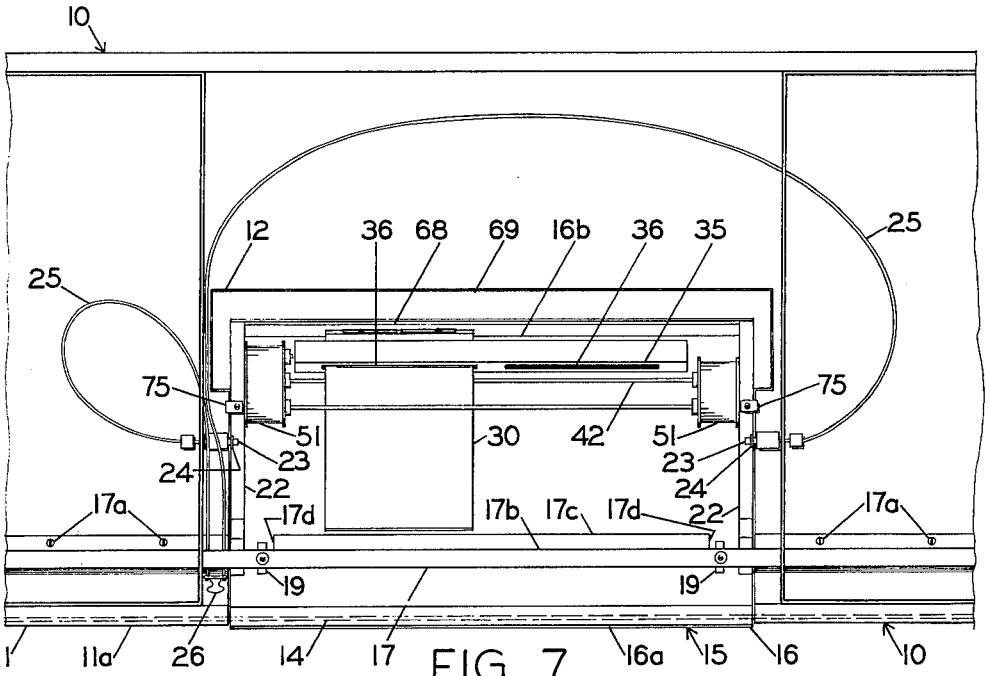
FIG. 7 is a partial bottom view of my desk mounted work support device with the primary work support member in an inclined position.
Figure 4:
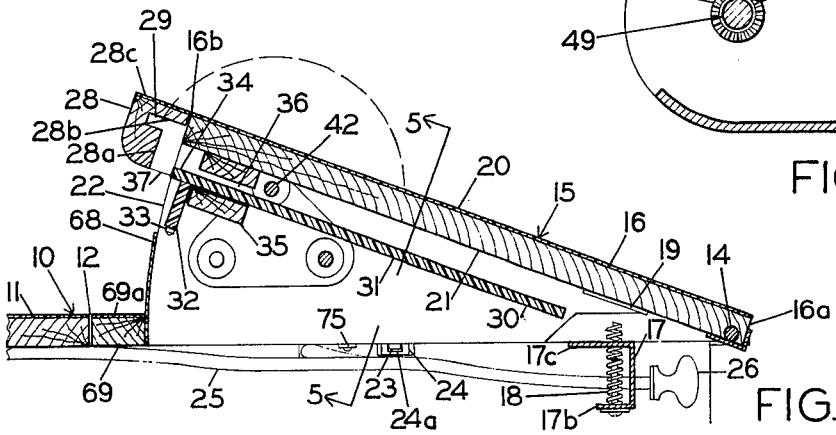
FIG. 4 is a section view of my work support device taken along section line 4—4 of FIG. 5, wherein the primary work support member is in an inclined position and the link arms and secondary work support member are positioned flush with the surface of the primary work support member.

My desk top work support device 15 is pivotally mounted within the cutout opening 12 of the desk top 11, preferably by means of a mounting rod 14 which extends through the desk top 11 and the primary work support member 16 of my work support device 15 near their front leading edges 11*a* and 16*a*, respectively, as best shown in FIGS. 4 and (in broken lines) 7. The primary work support member 16 is pivotable upon the mounting rod 14 whereby it may be positioned flush with the surface of the desk top 11 as in the storage position shown in FIG. 2, or at an angle to the desk top 11, as in the inclined working position best shown in FIGS. 1, 3 and 4. A channel member 17 is affixed to the underside of the desk top 11 on both sides of the cutout opening 12 by screws 17*a* or other suitable means, as shown in FIG. 7, to provide desirable structual rigidity to the desk 10, and also to provide a base for spring biasing the primary work support member 16 in an upwardly direction. Compression springs 18 are mounted on the channel member lower flange 17*b*, and extend upwardly through a cutout section 17*d* in the channel upper flange 17*c* to bear against a bearing plate 19 affixed to the underside of the primary work support member top panel 21, as shown in FIG. 4, to provide the desired upward biasing.

The primary work support member 16 has a primary work surface 20, which is preferably formed by an applied surfacing material suitable for desk tops, which will provide the desired desk top characteristics, such as appearance, surface texture, frictional characteristics, wearability, and resistance to stains and liguids. It will frequently be desirable for the primary work surface 20 to be of the same material as the upper surface of the desk top 11 so that the substantially continuous and plane surface provided when my desk top work support device 15 is positioned flush with the desk top 11 will have a uniform appearance.

Figure 5:
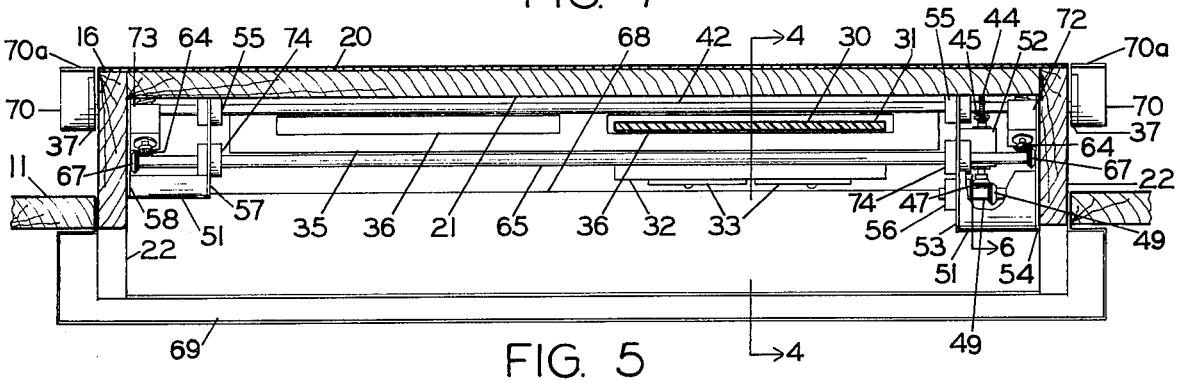
FIG. 5 is a section view taken along section line 5—5 of FIG. 4.

In the illustrated preferred embodiment, the primary work support member 16 has a top panel 21, as previously mentioned, and a pair of substantially wedge shaped side panels 22 which are secured to the side edges of the top panel 21 to form a rigid unit. As best illustrated in FIG. 5, the primary work surface 20 extends across the surface provided by the top panel 21 and the top edges of the side panels 22 in a continuous manner. The primary work surface 20, top panel 21 and side panels 22 will be commonly collectively referred to herein as the primary work support member 16.

The primary work support member 16 is maintained in each selected desired position by means of cable controlled, spring-loaded locking pins 23, shown in FIGS. 4 and 7, wherein the primary work support member 16 is being supported in its uppermost position by the pins extending through positioning detents or perforations 24*a* in support plates 24 secured to and recessed in the primary work support member side panels 22. Release cables 25 extend from the spring-loaded locking pins 23 to a release handle 26 mounted on the channel member 17. When the user pulls the handle 26, the spring-loaded pins 23 are retracted to permit the primary work support member to be pivoted up or down on the mounting rod 14. The biasing springs 18 will raise the primary work support member to a position intermediate to its storage and uppermost working positions if no additional resistance is placed on the primary work support member. The user may, by lifting or depressing the primary work support member 16, place it in whatever working position is desired. As best shown in FIG. 3, each support plate 24 extends arcuately upward along each side panel 22 of the primary work support member, and the perforations 24*a* are spaced to receive the locking pins 23 and secure the pivotable primary work support member 16 at each of several spaced working positions, as desired. Normally, it will be desirable to provide several working positions between the lower flush position illustrated in FIG. 2, and an uppermost position in which the primary work surface 20 will usually not be inclined at a greater angle than 30 degrees to the horizontal.

FIG. 4 illustrates to additional elements which may preferably be incorporated in the primary work support member. A rear panel 68 which may preferably be made of metal or plastic is secured to and extends between the rear edges of the side panels 22 to partially screen the interior of the primary work support member from view. A skirt 69 having an upper surface 69*a* extends outwardly from the rear panel 68, and also outwardly from each side panel 22, and is substantially flush with the desk top 11 and fills the portion of the desk top cutout opening 12 otherwise designed to receive the link arms 37 and secondary work support bar 28 in their storage position illustrated in FIG. 2, when the primary work support member is locked in its uppermost working position. The skirt 69 prevents papers and other desk top items from falling through the desk top cutout opening 12 onto the floor or the user's feet when my work support device 15 is in the working position shown in FIG. 1. In addition, limit stops 75 are preferably secured to the lower edges of the primary work support member side panels 22 and extend outwardly therefrom to engage the underside of the desk top 11 and prevent the primary work support member from being pivoted upward beyond its uppermost working position.

A secondary work support member 27 is rotatably supported by a pair of link arms 37 which are each pivotally mounted with respect to the primary work support member 16. The secondary work support member 27 preferably includes a secondary work support bar 28 of substantially the same length as the width of the primary work support member 16, and at least one removable secondary work holder 30. The link arms 37 are pivotally mounted at opposed locations adjacent the primary work support member side panels 22 and are of sufficient length to support the secondary work support bar 28 in a storage position rearwardly of the rear edge 16*b* of the primary work support member 16, as shown in FIGS. 2 and 4, and in a forward or "close reading" position in which the secondary work support bar extends across the mid-portion of the primary work surface 20, as shown in FIG. 3. The link arms 37 are described in more detail below. The secondary work support bar 28 has a longitudinal slot 29 which extends the full length of the bar 28, which is seen in FIG. 4 to have an essentially "J-shaped" cross section with a short front portion 28*a* and a longer rear portion 28*b*. The secondary work support bar 28 additionally has a flat surface 28*c* which is preferably formed of the same material as primary work surface 20. When the secondary work support bar is in its storage position with respect to the primary work support member, as shown in FIG. 4, the flat surface 28*c* is substantially flush with the primary work surface 20.

Figure 8:
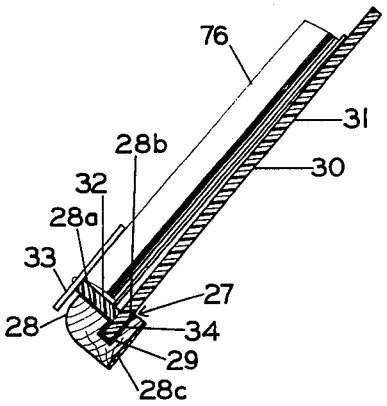
FIG. 8 is a section view of the secondary work support member of my desk top work support device taken along section line 8—8 of FIG. 1.

The secondary work support holder 30, which has a substantially L-shaped cross section, is engageable within the secondary work support bar to support a hook 76, reference papers or other materials on the secondary work support bar. The L-shaped secondary work support holder 30 has an upright plate 31, a lower arm 32, retaining arms 33 rotatably mounted on the front edge of the lower arm 32, and an extended lower section 34 which projects below the junction of the upright plate 31 and the lower arm 32. As shown in FIG. 8, one or more secondary work support holders 30 may be engaged on the secondary work support bar 28 with the extended lower section 34 of each holder engaged within the longitudinal slot 29 of the work support bar. Books and other reference materials are retained on the secondary work support holder 30 by means of the pivotally mounted retaining arms 33, as shown in FIG. 1.

FIGS. 4 and 5 show that the secondary work support holders 30 may be slideably engaged within slots 36 in the slotted rear storage bar 35 mounted on the underside of the primary work support member top panel 21. The primary work support member rear panel 68 is spaced from the top panel 21 a distance sufficient to permit slideable engagement and storage of the secondary work holders 30 in the storage bar 35. The structure of the secondary work support bar 28, secondary work support holder 29 and rear storage bar 35 and the uses of such members are substantially the same as the corresponding elements disclosed in my co-pending application Ser. No. 536,610.

The link arms 37 each have a pivoted end 37*a* and a connected end 37*b*, as best shown in FIG. 3. A connecting shaft 38 is fixedly engaged in each end of the secondary work support bar 28, is rotatably engaged by the connected end 37*b* of each respective link arm 37, and fixedly engages and supports a driven pulley 39. Accordingly, the secondary work support bar 28, the connecting shaft 38 and the driven pulley 39 are rotatable with respect to each link arm connected end 37*b*. The driven pulley 39, endless drive belt 40 and drive pulley 41 comprise a rotating means for rotating the secondary work support bar into a desired angular position on the link arms 37 for use or storage. The drive pulley 41 is fixedly mounted on a positioning shaft 42 which extends through both primary work support member side panels 22. A link arm drive cover 70 which fits over the driven pulley 39, endless belt 40 and drive pulley 41 is secured to each link arm 37 to conceal and protect the rotating means. The drive cover 70 has a flat surface 70*a* which is preferably of the same material as the primary work surface 20. When the link arms 37 are positioned to place the secondary work support bar in its storage position, as in FIGS. 2 and 4, the link arm drive cover flat surfaces 70*a* are substantially flush with the primary work surface 20. It should be understood that an equivalent rotating means comprising a gear train could be substituted for the driven pulley 39, endless belt 40 and drive pulley 41 with equally satisfactory results.

The above described rotating means is driven and controlled by a secondary work support drive means which can be best described with reference to FIG. 6. The secondary work support drive means of the preferred embodiment consists of a drive train 43, which includes a worm gear 44 secured on the positioning shaft 42, a worm 45 secured on a drive shaft 46 and engaged in driving relation with the worm gear 44, a drive shaft bevel gear 47 secured to the drive shaft, a handle shaft bevel gear 48 engaged with the drive shaft bevel gear and forming a right angle drive connection, and a handle shaft 49 secured to the handle shaft bevel gear 48 and extending through the outside drive housing wall to engage and support drive handle 50, which is recessed in the outer surface of the adjacent primary work support member side panel 22, as shown in FIG. 3. The drive shaft bearing assembly 52 is engaged on the drive shaft 46 between the drive shaft worm 45 and drive shaft bevel gear 47, and is mounted on the inside drive housing wall 53 to provide a secure mounting for the drive shaft 46 in fixed position with respect to the positioning shaft 42. The positioning shaft 42 is partially supported by a conventional bearing mount 55 which extends through the inside drive housing wall 53 as best shown in FIG. 5. The handle shaft 49 is supported by a conventional bearing mount 56 mounted on the inside drive housing wall 53. Each of said shafts also extends through conventional bearing mounts in the outside drive housing wall 54 and the adjacent side panel 22 to provide additional support for the shafts. It will be obvious that all of the rotating shafts employed in my preferred embodiment should be supported by suitable bearings in a conventional manner wherever required to provide for smooth, continuous operation of the rotating elements. On the opposite side of the primary work support member similar inside and outside drive housing walls 57 and 58 respectively support the rotating shaft members in a similar manner. Bottom plates 51 may optionally be provided in engagement with each housing wall pair 53 and 54, and 57 and 58, to protect the drive trains.

The pivoted ends 37*a* of the link arms 37 are fixedly secured to hollow pivot shafts 59 (shown by broken lines in FIG. 6) which are concentrically mounted on each end of the positioning shaft 42 to the inside of the drive pulleys 39. The pivot shafts 59 extend inwardly through the primary work support member side panels 22 and outside drive housing walls 54 and 58, respectively, and are rotatable with respect to the positioning shaft 42. Suitable conventional bearing mounts (not shown) are provided to support the pivot shafts in stable, rotatable position through the primary work support side panels 22.

Figure 6:
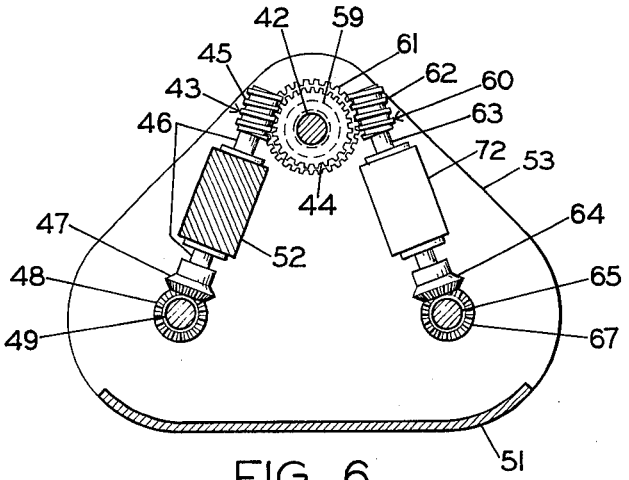
FIG. 6 is a partial section view showing details of the drive trains for the link arm drive means and the secondary work support member drive means, taken along section line 6 of FIG. 5.

As best shown in FIGS. 5 and 6, a link arm drive means is provided for pivoting the link arms 37 between desired positions. The link arm drive means employs a drive train 60 having twin branches which each include a pivot shaft worm gear 61 secured to each respective pivot shaft 59, a drive shaft worm 62 secured to a drive shaft 63 and engaged with the pivot shaft worm gear 61, and a drive shaft bevel gear 64 secured to the drive shaft. A handle shaft 65 extends across the entire inside width of the primary work support member 16 and supports a pair of handle gears 67, each of which is secured to the handle shaft 65 near each end thereof to engage a corresponding drive shaft bevel gear 64 associated with each of the link arms. The handle shaft 65 extends through outside drive housing wall 54 and the adjacent side panel 22, where a drive handle 66 is positioned on the shaft 65 in recessed position within the side panel 22. Accordingly, rotation of the drive handle 66 will cause the handle shaft 65 and handle bevel gears 67 to rotate, thereby causing the drive train for each link arm to rotate and the link arms 37 to pivot between their forward and storage positions.

A drive shaft bearing assembly 72 is mounted on the outside drive housing wall 54 and a drive shaft bearing assembly 73 is mounted on the outside drive housing wall 58 to provide a secure mounting for the respective drive shafts 63 with respect to the handle shaft 65 and the pivot shafts 59. The handle shaft 65 is supported by bearing mounts 74 mounted in the inside drive housing walls 53 and 57.

It should be understood that the support bearings for the various described rotating elements of my secondary work support drive means and link arm drive means may be selected in accordance with conventional engineering practice so that the drive handles 50 and 66 may be easily rotated between desired operating positions, but the link arms 37 and the secondary work support member 27 will retain whatever position is selected by the user when the drive handles are released. While the illustrated embodiment employs handles 50 and 66 for the purpose of rotating handle shafts 49 and 65, it is clear that rotation of the handle shafts could be accomplished by a reversible electric motor connected to each handle shaft by suitable belts and pulleys or other equivalent means. The motors, in turn, could each be controlled by separate switches positioned on the channel member 17 or other suitable location easily accessible to the user.

The construction of my improved desk top work support device 15 can be further understood from a discussion of its operation. In the storage position illustrated in FIG. 2, a relatively flat, substantially continuous work surface is provided which is similar to the work surface of a conventional desk. The flat surfaces of the desk top 11, primary work surface 20, secondary work support bar flat surface 28*c* and link arm drive cover flat surfaces 70*a* are seen to be separated only by clearance spaces of just sufficient size to permit relative movement of the adjacent surfaces. In particular, the desk top cutout opening 12 is shaped to closely accommodate the previously described primary work support member 16, link arm drive covers 70 and secondary work support bar 28.

When it is desired by the user to utilize the environmental design features of my improved desk top work support device, the release handle 26 may be pulled to permit the biasing springs 18 to raise the primary work support member 16 and attached elements to an intermediate position. The user then selects one of the several inclined working positions by raising or lowering the primary work support member to a position wherein release of the handle 26 will allow the spring-loaded locking pins 23 to engage the appropriate support plate perforations 24*a*. Assuming that the uppermost working position has been selected, my work support device 15 will then be in the position shown in FIG. 4.

If the user wishes to engage in predominantly reading tasks, handle 66 will be rotated to cause the link arms 37 to pivot forwardly until they reach the position shown in FIG. 3. The handle 50 will then be rotated until the secondary work support bar 28 is positioned with its longitudinal slot 29 opening upwardly and slightly rearwardly. A secondary work support holder 30 may then be withdrawn rearwardly from its storage position within the slotted rear storage bar 35 beneath the primary work support member top panel 21, and the extended lower section 34 of the holder engaged within the longitudinal slot 29 as shown in FIG. 8. The angle of the secondary work support holder 30 may then be adjusted precisely as desired by means of the handle 50. My work support device 15 will then be positioned substantially as illustrated in FIG. 3.

If the user wishes to engage in sustained combination reading and writing tasks, he may rotate handle 66 to cause the link arms 37 to pivot rearwardly to the approximate position illustrated by broken lines in FIG. 3. As the link arms 37 pivot, the positioning shaft 42 and its drive means including handle 50 remain stationary, as does drive pulley 41 secured to the positioning shaft. Accordingly, movement of the link arm 37 about the positioning shaft 42 results in arcuate displacement of the link arm with respect to the drive pulley 41, which in turn causes driven pulley 39 to be rotated with respect to the link arm in a direction opposite to the direction of travel of the link arm. If the driven pulley 39 and drive pulley 41 were of the same outside diameter, the angular position of the secondary work support member 27 would not change as the link arm 37 pivots from one position to another. However, as illustrated and described in my co-pending patent application Ser. No. 536,610, it is desirable for lighting and other purposes that the angular position of the secondary work support member 27 should be less inclined to the horizontal in the rearward secondary reference position than in the forward close reading position by approximately 20 degrees to permit use of a single position light source without glare to the user in either position, in accordance with good environmental design. This is accomplished with my improved work support device by employing a driven pulley 39 of greater diameter than drive pulley 41. For design purposes, the larger the diameter of driven pulley 39 with respect to drive pulley 41, the greater the angular difference of the secondary work support member 27 between its forward and rearward positions. If, however, the light source is not positioned in accordance with good environmental design, the angular position of the secondary work support member 27 may be easily adjusted in either of the described positions, or in any desired intermediate position, by rotation of the handle 50.

If the user wishes to return my desk top work support device 15 to its storage position, this may be quickly accomplished by removing the secondary work support holder 30 from the secondary work support bar 28 and returning it to its storage position in the slotted rear storage bar 35; rotating handle 50 until the secondary work support bar front surface **28*c* is co-planer with link arm drive cover flat surface 70*a;* rotating handle 66 to pivot the link arms 37 to the position wherein the link arm drive cover flat surface 70*a* is co-planer with the primary work surface 20; pulling release handle 26 to disengage the spring-loaded locking pins 23 from the support plate perforations 24*a;* pressing the primary work support member 16 downwardly against the resistance of the compression springs 18 until the primary work surface 20 is co-planer with the surface of the desk top 11; and releasing the handle 26 to permit the spring-loaded pins 23 to re-engage the uppermost support plate perforations 24*a* and lock the desk top work support device 15 in its storage position illustrated in FIG. 2.**

It is to be understood that my desk top work support device 15 can be constructed of any suitable known materials. It is to be further understood that my invention is not confined to the particular construction and arrangement of parts herein illustrated and described, but embraces all such modified forms, and equivalents thereof, as come within the scope of the following claims.

I claim:

1. A desk top work support device comprising:

a. an inclinable primary work support member having a primary work surface;

b. a secondary work support member;

c. at least one link arm having a pivoted end and a connected end, the pivoted end being pivotable with respect to the primary work support member and the connected end rotatably engaging the secondary work support member;

d. a positioning shaft mounted on the primary work support member; and e. rotating means comprising a drive member fixedly mounted on the positioning shaft, a driven member fixedly attached to the secondary work support member, and a drive connector engaged with the drive member and the driven member in connecting relation whereby pivotal movement of the link arm will cause rotation of the secondary work support member with respect to the link arm.

2. The desk top work support device specified in claim 1 wherein the positioning shaft is rotatably mounted on the primary work support member, and wherein a pivot shaft engages the link arm pivoted end in supporting relation and is mounted concentrically and independently rotatable with respect to the positioning shaft.

3. The desk top work support device specified in claim 2 wherein the pivot shaft and the positioning shaft each have a driven means mounted thereon, and including link arm drive means for rotating the pivot shaft driven means whereby the link arm may be pivoted with respect to the primary work support member, and secondary work support member drive means for rotating the positioning shaft whereby the secondary work support member may be rotated with respect to the link arm.

4. The desk top work support device specified in claim 3 wherein the link arm drive means comprises a drive train having at least one gear engaged with the pivot shaft driven means and having at least one shaft connected in driving relation to the gear, and having means driveably connected to the shaft for rotating the shaft.

5. The desk top work support device described in claim 3 wherein the secondary work support member drive means comprises a drive train having at least one gear engaged with the pivot shaft driven means and having at least one shaft connected in driving relation to the gear, and having means driveably connected to the shaft for rotating the shaft.

6. The desk top work support device specified in claim 1 wherein the link arm is pivotable between a forward position in which the link arm extends forwardly from the pivot shaft and the secondary work support member extends across the primary work surface to provide a close reading position and a rearward position in which the link arm extends rearwardly from the pivot shaft and the secondary work support member is located rearwardly from the primary work surface to provide a secondary reference reading position and to allow full access to the primary work surface, and wherein the rotating means will cause less arcuate rotation of the secondary work support member with respect to the link arm than the relative arcuate rotation of the link arm with respect to the primary work support member when the link arm is pivoted between its forward and rearward positions and the rotating means drive member remains stationary.

7. The desk top work support device specified in claim 1 wherein the rotating means drive member and driven member are pulleys and the drive connector is an endless belt connecting the pulleys in driving relation.

8. The desk top work support device specified in claim 7 wherein the driven member pulley is of larger circumference than the drive member pulley.

9. The desk top work support device specified in claim 1 wherein the primary work support member is mounted in a desk having a substantially flat upper surface and is movable between a position in which the primary work surface is substantially flush with the desk upper surface and a position in which the primary work surface is inclined with respect to the upper surface, the link arm has a flat surface and is pivotable on the primary work support member to a position wherein the link arm flat surface is substantially flush with the primary work surface, and the secondary work support member has a substantially flat surface and is pivotable to a position wherein the secondary work support member flat surface is substantially flush with the link arm flat surface, and wherein the desk upper surface has an opening shaped to receive the primary work support member, the link arm and the secondary work support mmember to provide a flat, substantially continuous work surface including the desk upper surface, the primary work surface, the link arm flat surface and the secondary work support member flat surface.

10. The desk top work support device specified in claim 9 wherein the primary work support member is biased toward its most upwardly inclined position, and including locking means for selectively securing the primary work support member in an inclined position and in a position wherein the primary work surface is substantially flush with the desk upper surface.

11. A desk top work support device comprising:

a. a desk having a desk top with a substantially flat surface and an opening;

b. an inclinable primary work support member pivotally mounted within the desk top opening and having a substantially flat primary work surface;

c. a secondary work support member having a substantially flat surface; and d. at least one link arm having a pivoted end which is pivotally mounted with respect to the primary work support member, a connected end rotatably engaging the secondary work support member, and a substantially flat surface, the link arm being pivotable between a forward position in which the link arm extends forwardly and the secondary work member extends across the primary work surface to provide a close reading position and a rearward position in which the link arm extends rearwardly and the secondary work support member is located rearwardly from the primary work support surface to provide a secondary reference reading position and to allow full access to the primary work surface;

e. the primary work support member, the secondary work support member and the link arm being movably to a storage position with the desk top opening to form a flat, substantially continuous work surface, which includes the flat surfaces of the desk top, the primary work surface, the secondary work support member and the link arm.

12. The desk top work support device specified in claim 11 including rotating means for rotating the secondary work support member withh respect to the link arm when the link arm is pivoted.

13. The desk top work support device specified in claim 12 including a positioning shaft mounted on the primary work support member, and wherein the rotating means includes a drive member fixedly mounted on the positioning shaft, a driven member fixedly attached to the secondary work support member and a drive connector engaged with the drive member and the driven member in driveable connecting relation.

14. The desk top work support device specified in claim 13 wherein the rotating means drive member and driven member are pulleys and the drive connector is a drive belt connecting the pulleys in driving relation.

15. The desk top work support device specified in claim 14 wherein the driven member pulley is of larger circumference than the drive member pulley.

16. The desk top work support device specified in claim 13 wherein the positioning shaft is rotatably mounted on the primary work support member, and wherein a pivot shaft engages the link arm pivoted end in supporting relation and is mounted concentrically and independently rotatable with respect to the positioning shaft.

17. The desk top work support device specified in claim 16 wherein the pivot shaft and the positioning shaft each have a driven means mounted thereon, and including link arm drive means for rotating the pivot shaft driven means whereby the link arm may be pivoted with respect to the primary work support member, and secondary work support member drive means for rotating the positioning shaft whereby the secondary work support member may be independently rotated with respect to the link arm.

* * * * *

UNITED STATES PATENT AND TRADEMARK OFFICE

CERTIFICATE OF CORRECTION

PATENT NO. : 4,040,592

DATED : August 9, 1977

INVENTOR(S) : Robert E. Jones

It is certified that error appears in the above-identified patent and that said Letters Patent are hereby corrected as shown below:

Column 1, Line 64 "mechanism" should be -- mechanisms--;

Column 3, Line 40 "desk" should be --desks--;

Column 5, Line 6 "to" should be --two--;

Column 5, Line 63 "hook" should be --book--;

Column 11, Line 16 "mmember" should be --member--;

Column 12, Line 5 "with" should be --within--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*